United States Patent [19]

De Widt

[11] Patent Number: 4,473,869

[45] Date of Patent: Sep. 25, 1984

[54] LUMINAIRE WITH RESILIENT SLEEVE AND BAND CONNECTION

[75] Inventor: Hugo De Widt, Oss, Netherlands

[73] Assignee: U.S. Philips Corporation, New York, N.Y.

[21] Appl. No.: 420,652

[22] Filed: Sep. 21, 1982

[30] Foreign Application Priority Data

Sep. 28, 1981 [NL] Netherlands ..... 8104430

[51] Int. Cl.[3] ..... H01R 33/00

[52] U.S. Cl. ..... 362/226; 362/370; 362/430; 362/389; 362/431; 362/396; 362/427; 339/1 L; 339/8 A; 339/88 R; 339/2 A; 339/46; 339/59 L; 339/61 L

[58] Field of Search ..... 362/226, 365, 368, 418, 362/370, 389, 396, 427, 430, 431; 339/1 L, 2 A, 2 L, 8 R, 8 A, 8 P, 8 PS, 8 PB, 45 T, 46, 59 L, 61 C, 88 R, 91 L, 176 L, 52 R

[56] References Cited

U.S. PATENT DOCUMENTS

| | | | |
|---|---|---|---|
| 1,096,440 | 5/1914 | Lynch | 339/8 A |
| 3,321,729 | 5/1967 | Phillips | 339/8 R |
| 3,466,648 | 9/1969 | Russenberger | 339/251 X |
| 3,585,564 | 6/1971 | Skjervoll | 339/8 P |
| 3,781,755 | 12/1973 | Pitacco | 339/176 L X |
| 3,798,588 | 3/1974 | Howe et al. | 339/176 L X |
| 3,800,267 | 3/1974 | Burgess et al. | 339/176 L X |
| 3,805,211 | 4/1974 | Moore | 339/176 L X |
| 4,326,769 | 4/1982 | Dorsey et al. | 339/8 P X |

FOREIGN PATENT DOCUMENTS

| | | | |
|---|---|---|---|
| 1215214 | 4/1960 | France . | |
| 718954 | 11/1954 | United Kingdom | 339/2 L |

*Primary Examiner*—Peter A. Nelson
*Attorney, Agent, or Firm*—Robert S. Smith

[57] ABSTRACT

Luminaire comprising a base in which there is an opening, and a lamp housing having a projecting tubular wall portion which is detachably lockable in the opening of the base and is rotatable therein around its longitudinal axis.

In accordance with the invention the said wall portion is provided around its end to be placed in the opening with a resilient metal sleeve, which is fixed in the axial direction, the tubular wall portion being rotatable with resistance within the sleeve. On placing the wall portion in the opening the sleeve assumes a fixed position with respect to the base.

4 Claims, 4 Drawing Figures

LUMINAIRE WITH RESILIENT SLEEVE AND BAND CONNECTION

Figure 1:
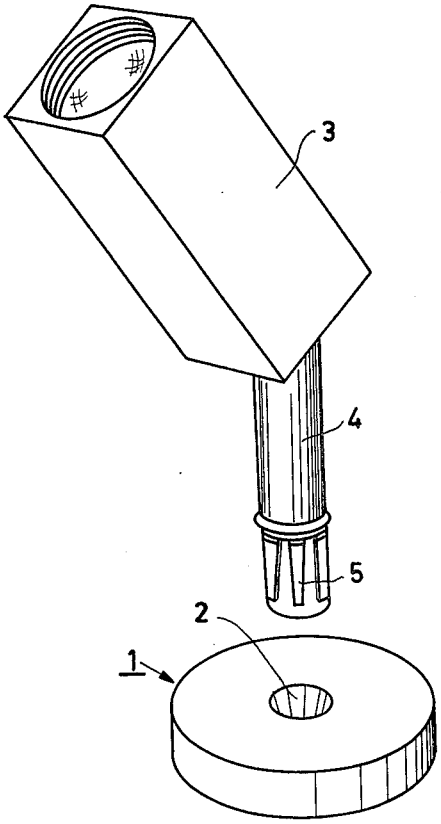

The invention relates to a luminaire comprising a base having an opening, the luminaire further comprising a house or housing to accommodate a lamp, the housing having a projecting tubular wall portion which is detachably lockable in the opening of the base and is rotatable therein about its longitudinal axis, the projecting tubular wall portion incorporating current conductors for the lamp which, on placing the wall portion in the opening, mate with current-carrying elements present in the base. Such a luminaire is described in French Patent Specification No. 1,215,214.

In said Patent Specification a luminaire is disclosed having a lamp house and a base which are interconnected by tubular supporting arms. The supporting arms can be coupled to each other and to the lamp housing and coupled to the base, respectively by means of contacting elements which can be rotated within said supporting arms and which at the same time serve as current conductors. In accordance with the said Patent Specification, such a contacting element is in the form of a central metal pin enveloped by a thin-walled metal cylinder which is electrically insulated from said pin. On coupling, two facing portions (cylinders and pins, respectively) are pushed into and against each other, respectively, locking in the axial direction being obtained by means of meshing ridges. In order to prevent, for example, two intercoupled supporting arms from rotating relative to each other about the longitudinal axis, the ends of the supporting arm walls are provided with teeth which mesh with each other on coupling.

Although then a lock is obtained which prevents the above-mentioned rotation from occurring, the lamp house can only be adjusted in certain positions (depending on the number of teeth and their pitch) with respect to the base. If a user wants to adjust the lamp housing to a different position relative to the base either the lamp housing or a supporting arm must be removed in its totality from an adjacent supporting arm or from the base. This is very inconvenient. A further disadvantage is that the mechanical lock in the axial direction is incorporated in current-carrying elements. These elements are then loaded mechanically in such a manner that during use damage easily occurs, so that not only the axial locking may be weakened but there is also the risk that sparks or even short-circuits can occur.

The invention has for its purpose to provide a luminaire of the type described in the opening paragraph which is of such a construction that, when placed in a (preferably circular) opening in the base, the lamp housing is fully rotatable through 360° and can be fixed in any desired position by a user, a mechanical load on the current-carrying element being avoided.

According to the invention, a luminaire of the type defined in the opening paragraph characterized in that the end of the tubular projecting wall portion to be placed in the opening in the base is surrounded by a sleeve of a resilient material, this sleeve being fixed on the wall in its axial direction, the tubular wall portion being rotatable with resistance inside the sleeve and the sleeve and the opening in the base being of such a shape that, when the wall portion is placed in the opening the sleeve assumes a fixed rotational position with respect to the base, this sleeve consisting of an endless, preferably metal, band which, located at some distance from the end of the projecting wall portion, closely fits around the outer circumference of the wall portion, this band having tongues which face the end of the wall portion, which are radially resiliently pushed against the wall portion and are located at regular intervals from each other, and whose ends engage the exterior wall of the wall portion.

The tubular projecting wall portion of the lamp housing of a luminaire in accordance with the invention is inserted in the opening in the base, the wall portion being locked in the axial direction and the lamp house (which in a practical embodiment is rigidly connected to the wall portion) is rotated to a desired position. Then the sleeve (consisting for example of a resilient metal or tin plate) exerts a predominantly radial pressure on the wall portion. When the lamp house with the wall portion is rotated with respect to the base, friction is produced between the sleeve and the wall portion, causing the rotary movement to be slightly impeded. Such a coupling with friction has the advantage that the lamp house is fixed with respect to the base in any position chosen by the user. A lamp house of a luminaire in accordance with the invention is fully rotatable through 360° in the opening and can be fixed in any desired position with respect to the base. The preferably cylindrical sleeve is then locked in a fixed position with respect to the opening to prevent rotation about its longitudinal axis. To that end the sleeve is provided with, for example, projections which mate with notches in the opening.

In a luminaire in accordance with the invention a mechanical load on the current-carrying elements is prevented from occurring. The forces produced on placing and rotating the tubular wall portion in the opening of the base are namely absorbed by the tubular wall portion or by the sleeve. During rotation of the lamp house with the wall portion in the base an electric connection is formed, for example, by metal wiping contacts located in the base, which bear against the current-carrying elements in the projecting wall portion and are connected to the line voltage power supply.

It should be noted that from United Kingdom patent Specification No. 546,236 it is known to interconnect two tubular members of a luminaire, the said members being rotatable to each other around their longitudinal axes. An "omega"-shaped metal spring is provided around a first tubular member, the spring being located in a recess in the outer wall surface of that member. The ends of the springs are at some distance from each other and are in the form of raised edges which, on connection, are accommodated in a groove in the inner wall surface of the second member. The spring then clamps around the first member, as a result of which said member can only rotate with friction in the spring. The walls of the two members then bear against each other substantially completely and directly. Particularly when the walls are made of a plastic material this is a drawback, as the rotary motion is stiff and therefore not easy for the user. Axial locking of the two members is effected by means of a screw connection between them. This is a complicated operation, more specifically when it must be done in not readily accessible positions, for example on a ceiling. The said patent Specification does not contain any information on current-carrying elements. The band fits in the opening in such a manner that in the region of the band and in the region of the tongue ends the band adequately supports the wall portion. The force exercised on the sleeve is regularly distributed over the band and the tongue on placing of the sleeve in the opening.

The wall portion of the lamp house in accordance with the invention may be fixed in the opening in the axial direction, for example by means of a clamp connection. In one preferred embodiment the sleeve comprises a means for detachably locking the tubular wall portion in the opening of the base. In this manner a reliable locking in the axial direction is obtained. In addition, special provisions for this purpose in the wall portion itself are superfluous.

In a specific embodiment the locking means is an outwardly extending resilient tongue obtained by making a longitudinal incision in the wall arm of the sleeve which tongue, when the sleeve is placed in the opening grips behind a projection provided in the base.

In a practical embodiment of a luminaire in accordance with the invention the sleeve consists of an endless, preferably metal, band which, located at some distance from the end of the projecting wall portion, closely fits around the outer circumference of the wall portion, this band having tongues which face the end of the wall portion, which are radially resiliently pushed against the wall portion and are located at regular intervals from each other, and whose ends engage the exterior wall of the wall portion. The band fits in the opening in such a manner that in the region of the band and in the region of the tongue ends the band adequately supports the wall portion. The force exercised on the sleeve is regularly distributed over the band and the tongue on placing of the sleeve in the opening.

In one embodiment the band further has a resilient tongue of a special shape, whose free end is formed such that, on placing in the base by means of a projection located in the base and mating with the tongue, a detachable locking in the axial direction is obtained. Furthermore, this tongue is preferably fastened to the band in such a way that it also serves to lock the band to prevent rotation around its axis.

Especially in order to fix a comparatively heavy lamp house rigidly in the opening of the base, the lock being intensified in the axial direction on placing of the lamp house, the projecting wall portion of the lamp house is provided in a special embodiment of the luminaire in accordance with the invention with an axially movable retaining ring with locking lug which can grip behind a locking, resilient tongue.

A luminaire in accordance with the invention is suitable for use in shops, dwelling houses, etc. The base is, for example, in the form of a circular supporting element suitable for fastening to a wall or a ceiling. In a special embodiment the luminaire comprises an elongate base provided with a plurality of comparatively closely spaced openings into which a projecting wall portion of the lamp housing can be inserted. In one practical embodiment the lamp housing is in the form of a "spot luminaire" fastened to the wall portion. In one special embodiment the lamp housing is in the form of a pendant lamp, the lamp housing being fastened to the tubular wall portion by means of a cable or a rod.

Figure 2:
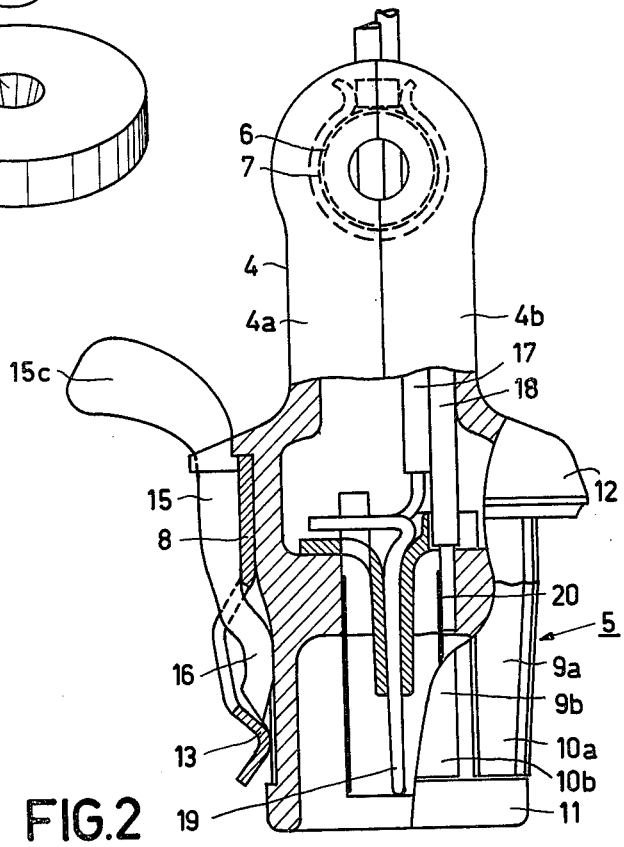
Figure 3:
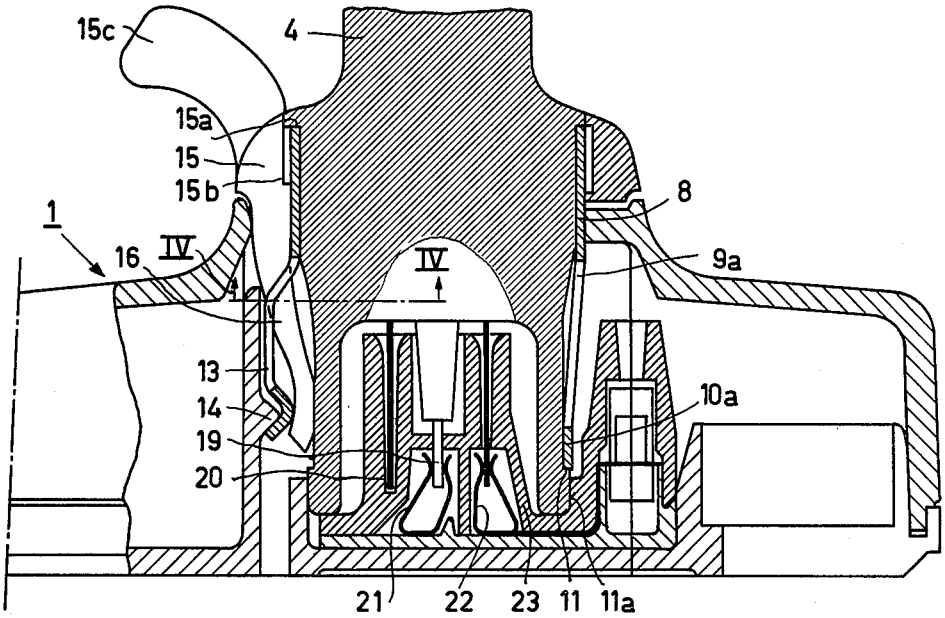
Figure 4:
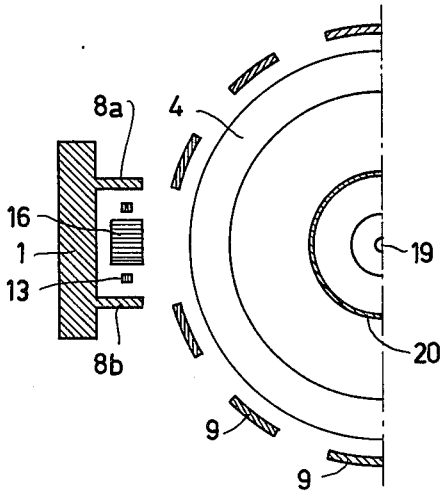

An embodiment of the invention will now be further described by way of example with reference to the accompanying drawings, of which:

FIG. 1 is an elevated view of a luminaire in accordance with the invention comprising a lamp housing and a base, FIG. 2 shows the tubular end of the lamp house, partly in a longitudinal cross-sectional view, FIG. 3 is a longitudinal cross-sectional view through a base incorporating the tubular end of the lamp housing, and FIG. 4 is a cross-sectional view through the plane IV—IV of FIG. 3.

The luminaire shown in FIG. 1 comprises a base 1 having an opening 2. In addition, the luminaire comprises a thin-walled plastic (for example polycarbonate) housing 3 for accommodating a lamp, for example an incandescent lamp. The house 3 has a projecting tubular wall portion 4, which is detachably lockable in the opening 2 of the base 1 and is rotatable about its longitudinal axis. The tubular wall portion 4 is provided with current conductors for the lamp which on placing of the wall portion 4 in the opening 2 mate with current-carrying elements incorporated in the base 1. That end of the portion 4 which faces the opening has a generally cylindrical metal sleeve 5. The tubular wall portion is shown in detail in FIG. 2.

The tubular wall portion 4 (see FIG. 2) comprises two cylindrical plastic envelopes 4*a*, 4*b*, which are split in the longitudinal direction and which are in intimate contact with each other. The lamp (not shown in FIG. 2) is fastened to the said wall portion and can be rotated relative to the wall portion to a predetermined position (for example through an angle of 90°). The interior wall of the wall portion 4 has a circular raised edge 6 which is rotatable in bearings positioned in the house. These bearings are metal springs 7 in the form of an "omega". The said springs 7 are fixed in a fixed position. Rotational friction is obtained by means of the bearing springs.

The sleeve 5 of a resilient material is in the form of a metal band 8, which is located at some distance from the free end of the wall portion 4 and which closely fits around the outer circumference thereof. This band 8 has a number of uniformly spaced tongues 9 facing the end of the wall portion and which are resiliently pushed radially inwards against the wall portion 4. (see FIG. 4). Two of these tongues 9 are visible in FIG. 2 and are denoted by 9*a* and 9*b*. The tongue portions bearing on the end are denoted by 10*a* and 10*b*. Near the end, the wall portion has a raised edge 11 which, together with edge 12 has for its object to fix the band 8 with tongues 9 in the axial direction.

In two places (one visible in the drawing) the band 8 comprises a means for detachably locking the wall portion in the axial direction in the opening of a base. This locking means is an outwardly-bent resilient tongue 13 which is partly bifurcate and, on positioning in the opening, engages behind a projection 14 in the base (see FIG. 3). The tongue 13 is attached to the band 8 and has an outwardly-projecting bulge which serves to lock the band 8 against rotation about its axis on positioning in the opening. Tongue 13 mates with two parallel edges 8*a* and 8*b* in the base (see FIG. 4). When positioned in the opening, the sleeve then assumes a fixed position relative to the base.

In addition, the projecting wall portion has an axially-movable retaining clip 15 with a locking lug portion 16, which engages behind the end of the said tongue 13 and retains it locked behind the projection 14. This strengthens the lock in the axial direction. The retaining clip 15 can be partly withdrawn by means of a handle 15*c* until portion 15*b* of the clip engages a lip 15*a* on portion 4; no releasing the lock.

The tubular wall portion 4 also incorporates current supply leads 17 and 18 (see FIG. 2) for a lamp to be placed in the lamp house. These wires are respectively connected to a central metal pin 19 and a metal cylinder 20. On placing the wall portion in the base, they mate (wiping contact) with current-carrying elements 21 and 22 located in the base 1. This is shown in FIG. 3. These elements 21 and 22 are surrounded by a raised plastic material wall 23 for the sake of safety. In use the elements 21 and 22 are connected to a line voltage power supply.

After the wall portion 4 has been inserted in the opening 2 a bearing is formed in two slightly spaced places of the wall portion. The first bearing is formed in the place where band 8 bears against the wall portion (in the region of the opening) and the second bearing is formed by a raised edge 11*a* located in the base and enclosing the said edge 11. The wall portion 4 is then fixed in a stable manner in the base.

I claim:

1. A luminaire comprising a base having an opening, and a housing to accommodate a lamp, the house having a projecting tubular wall portion which is detachably lockable in the opening of the base and is rotatable therein about its longitudinal axis, the projecting tubular wall portion incorporating current conductors for the lamp which, on placing of the wall portion in the opening, mate with current-carrying elements present in the base, characterized in that the end of the projecting tubular wall portion to be placed in the opening in the base is surrounded by a sleeve of a resilient material, this sleeve being fixed on the wall portion in its axial direction, the tubular wall portion being rotatable with resistance inside the sleeve and the sleeve and the opening in the base being of such a shape that, when the wall portion is placed in the opening the sleeve assumes a fixed rotational position with respect to the base, the sleeve consisting of a band, which is located at some distance from the end of the wall portion and which closely fits around the outer circumference of the wall portion, the band having tongues which are located at some distance from each other and face the end of the wall portion and resiliently push radially inward against the wall portion, the tongues having lug ends bearing against the exterior wall of the wall portion.

2. A luminaire as claimed in claim 1, characterized in that the sleeve comprises a means for detachably locking the tubular wall portion in the opening of the base.

3. A luminaire as claimed in claim 2, characterized in that the locking means is in the form of an outwardly bent resilient tongue in the wall of the sleeve, which tongue on placing the sleeve in the opening engages behind a projection provided in the base.

4. A luminaire as claimed in claim 3, characterized in that the projecting wall portion has an axially-movable retaining ring with a locking lug portion arranged to grip behind a locking tongue in the base.

* * * * *